US008578638B2

(12) United States Patent
Härter et al.

(10) Patent No.: US 8,578,638 B2
(45) Date of Patent: Nov. 12, 2013

(54) WORK MACHINE, IN PARTICULAR EXCAVATOR

(75) Inventors: Daniel Härter, Laubach (DE); Roland Wachter, Oberrot (DE); Bernd Wager, Kirchdorf (DE); Thomas Zitterbart, Dietenheim (DE)

(73) Assignee: Liebherr-Hydraulikbagger GmbH, Kirchdorf (DE)

( * ) Notice: Subject to any disclaimer, the term of this patent is extended or adjusted under 35 U.S.C. 154(b) by 238 days.

(21) Appl. No.: 12/974,351

(22) Filed: Dec. 21, 2010

(65) Prior Publication Data

US 2011/0150617 A1 Jun. 23, 2011

(30) Foreign Application Priority Data

Dec. 22, 2009 (DE) ..... 20 2009 017 388 U

(51) Int. Cl.
*E02F 3/38* (2006.01)
*B66C 3/16* (2006.01)

(52) U.S. Cl.
USPC ..... 37/466; 294/86.4

(58) Field of Classification Search
USPC ..... 37/318, 367, 461, 468; 175/28, 45, 238; 294/86.4, 112; 414/569, 732, 739, 730, 414/694, 726
See application file for complete search history.

(56) References Cited

U.S. PATENT DOCUMENTS

| | | | | |
|---|---|---|---|---|
| 3,301,587 | A | 1/1967 | Heikkinen | |
| 3,726,349 | A | 4/1973 | Heusler et al. | |
| 4,123,860 | A | 11/1978 | De Koning et al. | |
| 4,315,652 | A | 2/1982 | Barwise | |
| 4,497,608 | A * | 2/1985 | Sheppard et al. | 414/726 |
| 5,437,531 | A | 8/1995 | Kress | |

FOREIGN PATENT DOCUMENTS

| | | | |
|---|---|---|---|
| DE | 2501780 | | 7/1976 |
| DE | 3035250 | | 4/1982 |
| DE | 3142377 | A1 | 5/1983 |
| DE | 4428712 | | 2/1996 |
| DE | 19632030 | A1 | 2/1998 |
| DE | 19963691 | | 9/2000 |
| DE | 10361583 | | 7/2005 |
| DE | 202008008397 | | 3/2009 |
| EP | 1655417 | A2 | 5/2006 |

* cited by examiner

*Primary Examiner* — Robert Pezzuto
(74) *Attorney, Agent, or Firm* — Dilworth & Barrese, LLP.

(57) ABSTRACT

The present invention relates to a work machine, in particular to an excavator, having a boom, an extension element and a piece of working equipment, wherein the extension element is attached to a pivotal connection axle of the boom via a first gimbal mounting and bears the piece of working equipment, wherein the piece of working equipment is attached to a pivotal connection axle of the extension element via a second gimbal mounting.

17 Claims, 3 Drawing Sheets

WORK MACHINE, IN PARTICULAR EXCAVATOR

BACKGROUND OF THE INVENTION

The present invention relates to a work machine, in particular to an excavator, having a boom, an extension element and a piece of working equipment, wherein the extension element is attached to a pivotal connection axle of the boom via a first gimbal mounting and bears the piece of working equipment.

The work machine is in this respect in particular a hydraulic excavator to whose arm a gripper is attached via which bulk goods can be loaded. To increase the working range of such a work machine, extension elements are known which can be screwed between the mechanical gripper system and the gimbal gripper mounting. However, the gripper with the attached extension element has a very large lever length. This can also have a disadvantageous effect on the mechanical gripper system and can in particular result in damage to the ship's floor in port transfers.

SUMMARY OF THE INVENTION

It is therefore the object of the present invention to provide a work machine having an extended working range which has improved mechanical properties.

This object is achieved in accordance with the invention by a work machine as described herein.

The work machine in accordance with the invention, in particular an excavator, in this respect has a boom, an extension element and a piece of working equipment, wherein the extension element is attached to a pivotal connection axle of the boom via a first gimbal mounting and bears the piece of working equipment. In accordance with the invention, provision is made in this respect that the piece of working equipment is attached to a pivotal connection axle of the extension element via a second gimbal mounting. The damaging torques which arise due to the long lever arm in the prior art are avoided by this dual gimbal mounting. The load thus essentially corresponds to that of a singly attached piece of working equipment despite the extension. Furthermore damage to the base, e.g. a ship's floor, in port transfers, is avoided. A more uniform wear of the piece of working equipment, in particular a more uniform wear of a gripper over the width of the cutting edge, moreover results, The work machine is in particular an excavator. It advantageously has an undercarriage having a chassis. A boom is furthermore advantageously provided which can be luffed up and down about at least one horizontally arranged axis. In this respect, a pivotal connection axle for a piece of working equipment is usually arranged at the tip of the boom. The excavator can in particular be a hydraulic excavator. The boom is in this respect movable via at least one hydraulic cylinder. The piece of working equipment can advantageously be a gripper with which bulk goods can be loaded.

The first gimbal mounting in this respect advantageously allows a freely oscillating attachment of the extension element to the boom. Further advantageously, the second gimbal mounting allows a freely oscillating attachment of the piece of working equipment to the extension element. Each of the gimbal mounts in this respect advantageously allows a movement about two pivot axes which stand perpendicular to one another.

Provision is further advantageously made that the extension element can be removed and the piece of working equipment can be attached to the pivotal connection axle of the boom via the first or the second gimbal mounting. The pivotal connection axle at the boom in this respect in particular corresponds to the pivotal connection axle at the extension element. Further advantageously, the first gimbal mounting corresponds to the second gimbal mounting. The extension element can thus simply be suspended via the first gimbal mounting between the boom and the second gimbal mounting of the piece of working equipment. A simple structure hereby results. The assembly and dismantling of the extension element is furthermore possible without problem. Corresponding pieces of working equipment can be attached to the extension element via already present mountings without additional parts being required.

Provision is further advantageously made that the piece of working equipment is hydraulically driven and the extension element has hydraulic lines and hydraulic connections via which hydraulic connections at the boom are connectable or connected to hydraulic connections at the piece of working equipment. Advantageously, all hydraulic connections and hydraulic lines are therefore already present at the extension element via which the piece of working equipment is supplied with hydraulic fluid. The piece of working machine can in this respect e.g. be a gripper whose mechanical system is hydraulically actuated.

Furthermore, a fast-changing device can be provided for connecting the piece of working equipment to the extension element. Such a fast-changing device in this respect advantageously simultaneously allows the mechanical and the hydraulic connection between the piece of working equipment and the extension element. Alternatively or additionally, an automatic mechanical connection can also be provided.

Provision is advantageously made in this respect that the fast-changing device is arranged between the extension element and the second gimbal mounting. Pieces of working equipment can thus in particular be arranged without problem at the extension element using a gimbal mounting and a fast-changing device.

Provision can furthermore be made that the extension element can be telescoped out. Only one extension element is hereby required to allow different working ranges.

Provision can further advantageously be made that a braking apparatus is associated with one or more joint axles of the first and/or second gimbal mountings. A respective braking apparatus is in this respect in particular associated with both joint axles of the first and/or of the second gimbal mountings. In this respect, a respective braking apparatus is associated with at least the two joint axles of the second gimbal mounting Such a braking apparatus in this respect in particular allows the fixing and/or torque-limitation of the corresponding pivot axle. A limiting of the transferrable torque in this respect allows a kind of overload protection. Further applications of the extension element are possible by the fixing of corresponding joint axles. The extension can e.g. also be used for deep shafts by fixing some joint axles. The cutting out of perpendicular walls in particular becomes possible. In this respect, damage to the mechanical gripper system can be avoided by the braking device in that the brake yields on an overload.

The actuation of the brake can in this respect be controllable by a control of the work machine. In this respect, in particular a brake actuator can be provided, e.g., a hydraulic brake actuator via which the braking device can be actuated. Alternatively, the brakes can also be actuable or adjustable by hand, e.g. by tightening a screw.

Provision can furthermore be made that the function of the brake is coupled to the function of the piece of working equipment. The brake can e.g. be actuated when the gripper closes.

The braking apparatus can in this respect e.g. be made as a disk brake, as a multi-disk brake or as a band brake.

Provision can furthermore be made that the pivot angle of one or more joint axles of the first and/or of the second gimbal mountings can be bounded or fixed via stops. Such stops thus permit a simple mechanical bounding or fixing of the joint axles for corresponding application situations.

The abutments are in this respect advantageously releasably fastenable. The stops can hereby, if they are needed, be attached correspondingly to the piece of working equipment. In this respect, a set of different stops can advantageously be provided to achieve different pivot angles. Alternatively, the stops can also be attachable in different positions of the piece of working equipment. The stops can in this respect in particular be screwed on.

The piece of working equipment in accordance with the invention is advantageously a gripper. Further advantageously, the piece of working equipment is used in this respect for the transfer of bulk goods such as sand, gravel, coal, fertilizer or scrap. The mechanical loads are substantially reduced here by the extension element in accordance with the invention by the dual gimbal mountings. Damage to the ship's floor is moreover in particular avoided in port transfers.

Alternatively, the work machine in accordance with the invention can also be used for deep shafting. The piece of working equipment is in this respect in particular a piece of working equipment for deep shafting. The work machine can in this respect advantageously in particular be used for cutting out perpendicular walls. One or more of the joint axles of the first and/or second gimbal mountings can advantageously be fixed for this purpose, in particular via a braking apparatus and/or stops.

In addition to the work machine, the present invention furthermore relates to an extension element for a work machine, as was described above. The extension element in this respect in particular has a first gimbal mounting via which it can be attached to a pivotal connection axle of a boom. Further advantageously, the extension element has a pivotal connection axle to which a piece of working equipment can be attached via a second gimbal mounting. In this respect, the pivotal connection axle at the extension element, via which the piece of working element can be attached thereto, corresponds to the pivotal connection axle to which the first gimbal mounting can be attached.

An extension element in accordance with the invention in this respect advantageously has a length of more than 50 cm, further advantageously of 1 m or more.

Further advantageously, the present invention includes a set of a plurality of extension elements such as were described above. Such a set of a plurality of extension elements of different lengths in this respect allows a flexible adaptation of a work machine to different work situations. Such a set can e.g. have a first extension element of a meter in length, a second extension element of two meters length and, optionally, a third extension element of three meters in length. Other length embodiments are naturally also possible.

The work machine in accordance with the invention can in this respect in particular be used in the transfer of bulk goods in the port area, in particular for the loading and/or unloading of ships.

BRIEF DESCRIPTION OF THE DRAWINGS

The present invention will now be explained in more detail with reference to embodiments and to drawings. There are shown.

DESCRIPTION OF THE PREFERED EMBODIMENTS

The preferred embodiment of a work machine in accordance with the present invention is an excavator, in particular a hydraulic excavator. In this respect, the excavator has a chassis via which it is movable. The excavator can in this respect in particular have at least two wheeled axles. Alternatively, a crawler unit can also be provided. The excavator furthermore has a boom which is pivotally connected to the excavator about at least one horizontal axis and can be lulled up and down about it. One or more hydraulic cylinders are in particular provided for this purpose. In this respect, the excavator can have a superstructure which is rotatable about a vertical axis of rotation with respect to the undercarriage. The boom is advantageously pivotally connected to the superstructure. Alternatively or additionally, the boom can also be pivotable about a vertical axis of rotation with respect to the excavator. The boom is in particular an excavator arm.

Figure 1:
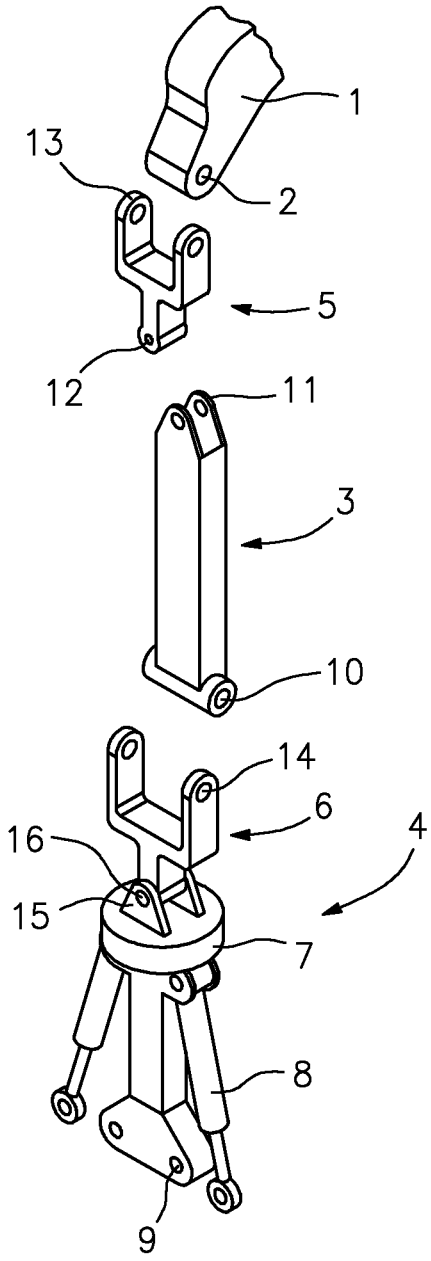
FIG. 1: a first embodiment of an extension element in accordance with the invention.

In this respect, the boom has a pivotal connection axle at its free end for mounting of a piece of working equipment. In this respect, the arm end of the excavator arm 1 with the pivotal connection axle 2 is shown in FIG. 1. The pivotal connection axle 2 can in this respect in particular be a standard mount for attaching pieces of working equipment, e.g. a mount of the G type.

The piece of working equipment can in particular be a gripper 4. Such a gripper is shown as an embodiment in FIG. 1. In this respect, the gripper has a mechanical gripper system 8 via which gripper buckets, not shown, are movable. The gripper buckets are in this respect fastened to pivotal connection axles 9 at the gripper and are movable via the hydraulic cylinders 8 so that the gripper can be opened and closed. The gripper in the embodiment furthermore has a rotary drive 7 with which it can be rotated about a vertical axis.

In accordance with the invention, the gripper 4 is attached to the boom 1 in a dual gimbal fashion via an extension element 3. For this purpose, a first gimbal mounting 5 is provided via which the extension element 3 is attached to the pivotal connection axle 2 of the boom 1. The extension element 3 has in turn a pivotal connection axle 10 to which the gripper 4 is attached via a second gimbal mounting 6. The pivotal connection axle 10 at the extension element 3 in this respect corresponds to the pivotal connection axle 2 at the boom 1. The gripper 7 can hereby also be attached to the pivotal connection axle 2 of the boom 1 via the second gimbal mounting 6.

The connection of the gimbal mountings to the respective pivotal connection axles advantageously takes place via pin connections. A releasable connection of the respective mounting to the pivotal connection axles is hereby possible.

The structure of the first and of the second gimbal mountings will now briefly be described. The first gimbal mounting 5 in this respect has a first pivotal connection axle 13 via which it can be attached to the pivotal connection axle 2 at the boom. The first pivotal connection axle 13 is in this respect provided by a fork. The gimbal element furthermore has a second pivotal connection axle 12. It stands perpendicular on the first pivotal connection axle 13. The gimbal element can be pivotally connected to a pivotal connection axle 11 of the extension element via the second pivotal connection axle 12. The extension element 3 is hereby connected in a freely oscillating manner to the boom 1 via the two axles.

The second gimbal mounting 6 is made identical to the first gimbal mounting 5. In this respect, it has a first pivotal connection axle 14 for the pivotal connection to the pivotal connection axle 10 of the extension element or to the pivotal connection axle 2 of the boom 1. It furthermore has a second pivotal connection axle 16 which stands perpendicular on the first pivotal connection axle 14. A pivotal connection axle 15 of the gripper 4 is attached to the second gimbal mounting via the second pivotal connection axle 16. A mounting of the gripper to the extension element 3 oscillating freely about the two axles hereby in turn results.

Figure 6:
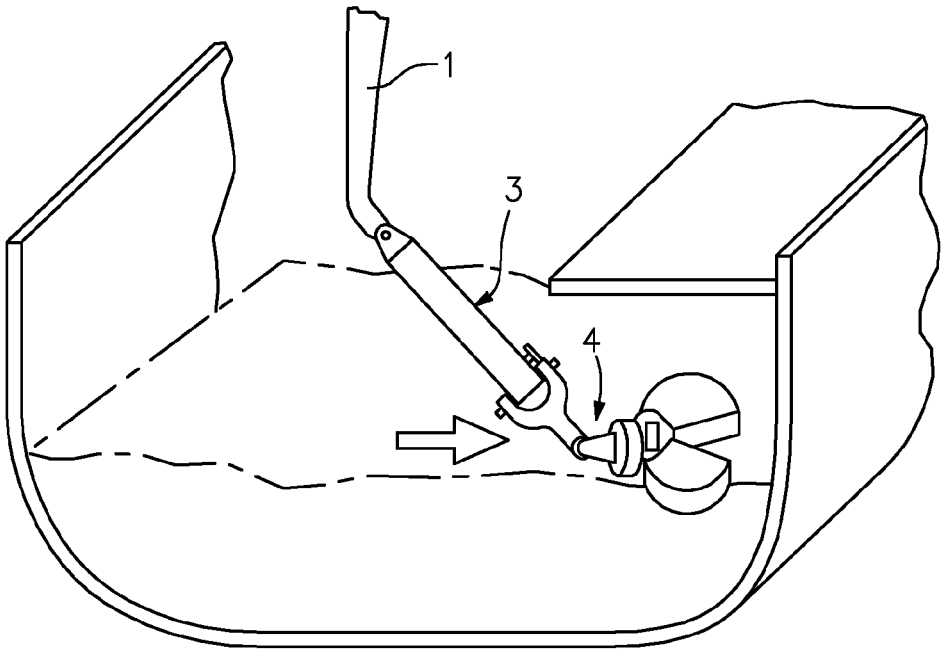
FIG. 6: a use of the extension element in accordance with the invention.

The extension element in accordance with the invention can be used to increase the working range, e.g. on the unloading of a ship at a river port, as is shown in FIG. 6. The work machine in accordance with the invention is thus a transfer machine Application areas can in this respect e.g. be bulk material such as sand, gravel, coal, fertilizer, etc. A use for scrap is likewise conceivable.

Damaging torques on the gripper or on the base are avoided by the simple attachment of the gripper extension between the arm end and the gripper mounting and the dual gimbal mounting which hereby results. In this respect, an extremely simple attachment and removal results since the gripper does not have to be taken apart for the extension. It is rather the case that any desired grippers can be attached to the extension and to the extension to arm end via the already present, different grip mountings. No different variants are therefore required for different grippers.

A simple kit of differently long extensions can furthermore be built up. The extension 3 can e.g. in this respect have lengths of exactly one meter, two meters, three meters, etc.

Provision is made in a further advantageous manner that the extension element already has all the required connections for the hydraulic supply of the piece of working equipment. This is shown in the embodiment in FIG. 2. Hydraulic lines 17 are attached to the extension 3 in this respect. They have hydraulic connections 18 and 19 via which they can be connected to hydraulic lines at the boom 1 as well as at the piece of working equipment 5.

The lines can also be laid in a protected manner in the box of the extension. Alternatively, a protective element can be attached next to or above the lines.

It is furthermore conceivable in an embodiment to equip the extension element 3 with a fast-changing device at the free end. Such a fast-changing device in this respect e.g. permits a simultaneous mechanical and hydraulic connection between the piece of working equipment and the extension element 3. Alternatively or additionally, an automatic mechanical coupling would also be possible via a corresponding mechanical pin system.

Figure 2:
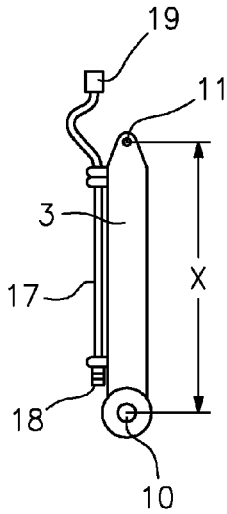
FIG. 2: a second embodiment of an extension element in accordance with the invention.

In the embodiment of an extension element 3 shown in FIG. 1, the upper pivotal connection axle 11 for pivotal connection to the first gimbal mounting stands perpendicular on the second pivotal connection axle 10 for the attachment of the second gimbal mounting. The alignment of the two axles to one another is, however, not decisive. The upper pivotal connection axle 11 can thus, as shown in FIG. 2, also extend parallel to the lower pivotal connection axle 10. The upper and the lower pivotal connection axles in this respect each stand perpendicular on the longitudinal axis of the extension element 3.

The extension element 3 is advantageously made as a right steel construction. A box construction is in particular used in an advantageous manner for this purpose. In this respect, two walls of this box form lugs with bores at the upper end which provide the pivotal connection axle 11. At the lower end, in contrast, a cylinder is welded to the box construction and provides the lower pivotal connection axle 10.

It is furthermore conceivable to block individual joint axles of the first and/or second gimbal mountings via braking devices or to limit the transferrable torque. This is shown with reference to embodiments in FIGS. 3 and 4. In this respect, a respective braking apparatus is shown which is associated with a first joint axle of the second gimbal mounting. The braking arrangement is therefore arranged at the lower end of the extension element 3. The braking apparatus has a brake disk 20 which is used via the brake caliper 21 for the fixing and for the torque limitation at the rotational axle formed by the pivotal connection axles 10 and 14.

Figure 3:
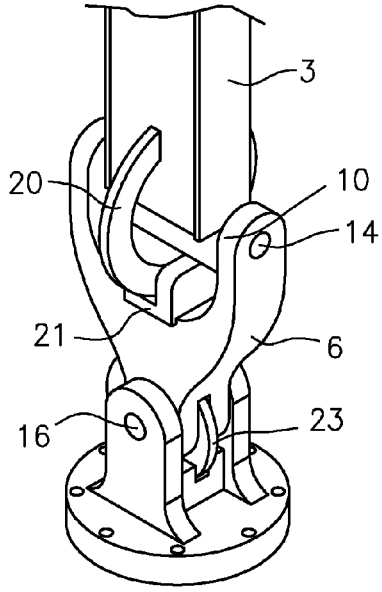
FIG. 3: a section of a third embodiment of an extension element in accordance with the invention in a perspective view.

The brake caliper is in this respect arranged at the gimbal element 6; the brake disk 20 at the lower side of the extension element 3. In this respect, a central arrangement of the brake disk 20 is shown in FIGS. 3 and 4. In FIG. 4*b*, in contrast, an arrangement of the brake disk and of the brake caliper outside at the pivotal connection axle is shown.

Figure 4A:
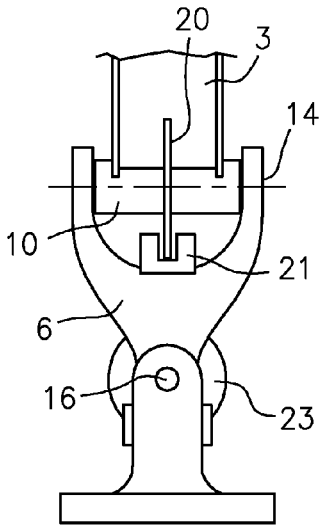
FIG. 4*a*: the embodiment shown in FIG. 3 in a side view.
Figure 4B:
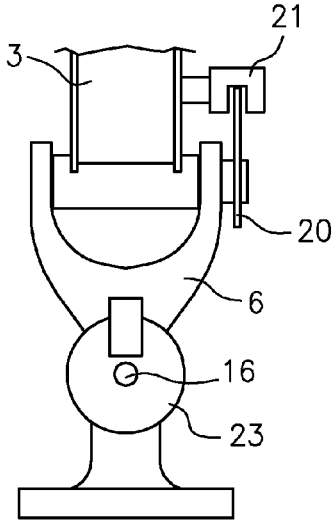
FIG. 4*b*: an alternative embodiment to the embodiment shown in FIG. 3*a* and FIG. 4*a;*

Corresponding braking apparatus are also used in the embodiment variants in accordance with FIGS. 3, 4*a* and 4*b* shown here for the other or further joint axles of the mounting. Reference must be made here to the brake disk 23 in the region of the axle 16 and to the associated brake caliper.

Figure 5:
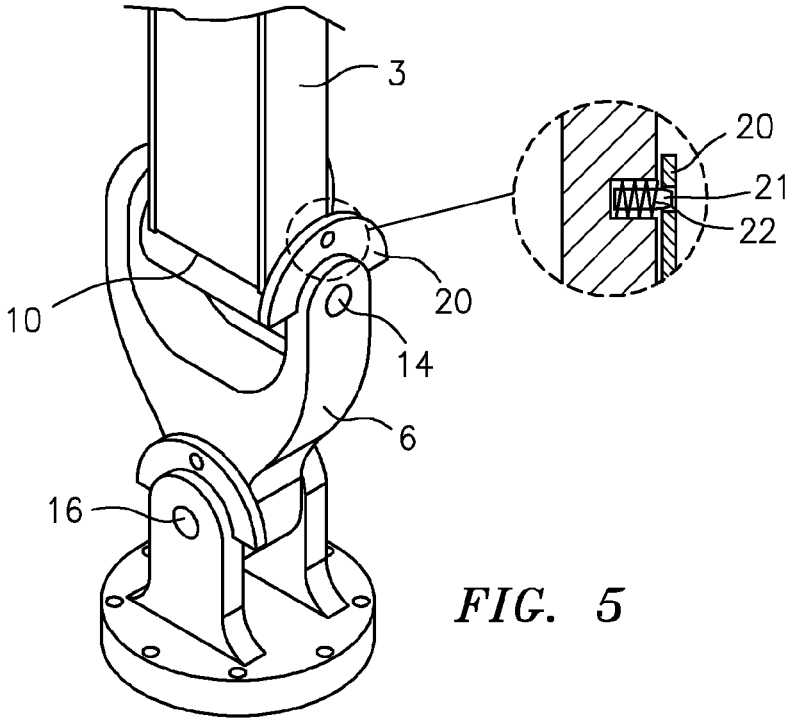
FIG. 5: a third embodiment of an extension element in accordance with the invention.

Alternatively to the brake disk shown here, multi-disk brakes, band brakes, etc. can also be used. In FIG. 5, an embodiment variant is shown in which a movable pin loaded by means of a spring engages into an opening 21 of the brake disk 20. This mechanism replaces the brake saddle. The pin 22 is latched in a perpendicular position of the extension element 3. On a pivoting of the extension element 3, the pin can come out of engagement on exceeding of a specific limit force. On a renewed perpendicular position of the extension element 3, the pin again engages into the opening 21. A security against overload is hereby provided. The purpose of this security against overload is to keep the lower joint rigid up to the reaching of a defined torque. On an exceeding of this torque, the blocking is cancelled as with an overload coupling so that the lower mounting oscillates freely. An overload of the extension and of the gripper can hereby be prevented. Work can be carried out with a rigid extension up to the reaching of the overload.

The extension element can also be used for deep shafts due to the braking apparatus. The cutting out of perpendicular walls in particular thus becomes possible. In this respect, the brake yields on an overload and thus avoids damage to the mechanical gripper system. The actuation of the braking apparatus can in this respect either be separately controllable or coupled to a function of the piece of working equipment. The actuation of the braking apparatus can e.g. in this respect be coupled to the actuation of the gripper and can likewise close on a closing of the gripper.

Alternatively or additionally, the pivot angles of the joint axles can be bounded by stops or also be fixed for specific work. Corresponding stops are advantageously screwed to the joint axles for this purpose. It can in particular be a kit system having different stops.

Furthermore a telescopic extension is conceivable with which the length of the extension element 3 can be changed via at least one telescopic stroke.

The present invention represents a substantial mechanical improvement with respect to known extensions by the dual gimbal mounting via the extension element. The load substantially does not go beyond the load situation in a directly attached piece of working equipment with the extension element in accordance with the present invention. In addition to the avoidance of damage to the mechanical system of the piece of working equipment and to the lower wear at the piece of working equipment, damage to the base, in particular the ship's floor, is avoided.

The extension in accordance with the invention can in this respect be used with all transfer machines, in particular with transfer machines for bulk good and/or scrap. The extension can thus be used to increase the working range, in particular on the use of a gripper as the piece of working equipment. Further application possibilities are given by the fixing of individual axles.

The invention claimed is:

1. A work machine having a boom,
an extension element, and
a piece of working equipment, wherein
the extension element is attached to a pivotal connection axle of the boom via a first gimbal mounting and bears the piece of working equipment,
the piece of working equipment is attached to a pivotal connection axle of the extension element via a second gimbal mounting, and
a braking apparatus is associated with one or more joint axles of at least one of the first and second gimbal mountings for at least one of fixing and limiting torque of the respective joint axle.

2. A work machine in accordance with claim 1, wherein the extension element can be removed and the piece of working equipment can be attached to the pivotal connection axle via the first or the second gimbal mounting.

3. A work machine in accordance with claim 1, wherein the piece of working equipment is hydraulically driven and the extension element has hydraulic lines and hydraulic connections via which hydraulic connections at the boom are connectable or connected to hydraulic connections at the piece of working equipment.

4. A work machine in accordance with claim 1, comprising a fast-changing device for connecting the piece of working equipment to the extension element, wherein the fast-changing device is advantageously arranged between the extension element and the second gimbal mounting.

5. A work machine in accordance with claim 1, wherein the extension element is telescopic.

6. A work machine in accordance with claim 1, wherein the pivot angle of one or more joint axles of at least one of the first and second gimbal mountings is bounded or fixed via stops.

7. A work machine in accordance with claim 1, wherein the piece of working equipment is a gripper for the transfer of bulk goods.

8. A work machine in accordance with claim 1, wherein the piece of working equipment is configured for the cutting out of perpendicular walls of deep shafts.

9. A work machine in accordance with claim 6, wherein the stops are releasably fastenable.

10. A work machine in accordance with claim 1, wherein the pivot connection axles (10, 11) of the extension element (3) are oriented substantially perpendicularly to one another.

11. A work machine in accordance with claim 1, wherein the braking apparatus comprises
a disc (20) positioned at one end of the extension element (3) or on the second gimbal mounting (6), and
a caliper (21) positioned on the other of the second gimbal mounting (6) or end of the extension element (3).

12. A work machine in accordance with claim 11, wherein the disc (20) and caliper (21) are centrally arranged on the respective extension element (3) end and second gimbal mounting (6).

13. A work machine in accordance with claim 11, wherein the disc (20) and caliper (21) are respectively arranged on a pivot connection axle (14) of the second gimbal mounting (6) and extension element (3) end outside of the second gimbal mounting (6) and extension element (3).

14. A work machine in accordance with claim 11, wherein the second gimbal mounting (6) comprises an additional braking apparatus at an end opposite the braking apparatus for the extension element (3) and constituted by one of a disc (23) or caliper mounted thereon.

15. A work machine in accordance with claim 1, wherein the braking apparatus comprises
a disk (20) mounted on the second gimbal mounting (6) and having an opening (21), and
a pin (22) movably biased by a spring in a recess of the extension element (3), such that the pin (22) engages the opening (21) of the disk (20) and latched in a perpendicular position of the extension element (3), but on pivoting of the extension element (3), is disengaged from the opening (21) of the disk (20) on exceeding a specific limit force.

16. A work machine having
a boom,
an extension element, and
a piece of working equipment, wherein
the extension element is attached to a pivotal connection axle of the boom via a first gimbal mounting and bears the piece of working equipment,
the piece of working equipment is attached to a pivotal connection axle of the extension element via a second gimbal mounting, and
each said gimbal mounting is shaped as a fork having prongs through which a first joint axle extends and a stem through which a second joint axle extends in a substantially perpendicular direction to the first pivotal connection axle.

17. A work machine in accordance with claim 16, wherein the pivot connection axles (10, 11) of the extension element (3) are oriented substantially perpendicularly to one another.

* * * * *